US010215528B2

(12) United States Patent
Joros

(10) Patent No.: US 10,215,528 B2
(45) Date of Patent: Feb. 26, 2019

(54) RIFLE GRIP DEVICE

(71) Applicant: Nicholas A. Joros, Santa Clara, CA (US)

(72) Inventor: Nicholas A. Joros, Santa Clara, CA (US)

( * ) Notice: Subject to any disclaimer, the term of this patent is extended or adjusted under 35 U.S.C. 154(b) by 0 days.

(21) Appl. No.: 15/702,915

(22) Filed: Sep. 13, 2017

(65) Prior Publication Data

US 2018/0112949 A1 Apr. 26, 2018

Related U.S. Application Data

(60) Provisional application No. 62/410,993, filed on Oct. 21, 2016.

(51) Int. Cl.
*F41C 23/16* (2006.01)

(52) U.S. Cl.
CPC ..... *F41C 23/16* (2013.01)

(58) Field of Classification Search
USPC ..... 42/72, 74
See application file for complete search history.

(56) References Cited

U.S. PATENT DOCUMENTS 2,903,811 A * 9/1959 Freed ..... F41C 23/10 42/59
D439,628 S * 3/2001 Tugwell ..... D22/100
6,658,781 B1 * 12/2003 Bowen ..... F41C 23/12 42/71.02
8,720,098 B2 5/2014 Burress
8,752,321 B2 * 6/2014 Burress, Jr. ..... F41C 23/22 42/71.01
9,395,151 B2 * 7/2016 Somogy ..... F41C 23/16
9,568,273 B2 2/2017 Thordsen
2011/0107642 A1 * 5/2011 Godard ..... F41C 23/10 42/71.01
2012/0125189 A1 * 5/2012 McLean, III ..... F41A 17/063 89/132
2017/0059272 A1 3/2017 Cazes

* cited by examiner

*Primary Examiner* — Samir Abdosh

(74) *Attorney, Agent, or Firm* — Patentfile, LLC; Bradley C. Fach; Steven R. Kick

(57) ABSTRACT

A rifle grip device may include a body configured to be attached to a pistol grip interface of a firearm with the body having a first end and a second end. A receiver plate may be disposed on the body, and the receiver plate may have a receiver mating surface. A stock plate may be disposed on the body, and the stock plate may have a stock mating surface disposed between the receiver plate and the second end. A one or more finger ridges may be disposed on the body opposite to the stock plate. One or more finger surfaces may extend along the body and onto and/or between the finger ridges so that the one or more finger surfaces may be generally horizontally aligned between the first end and second end of the body.

9 Claims, 4 Drawing Sheets

RIFLE GRIP DEVICE

CROSS REFERENCE TO RELATED APPLICATIONS

This application claims priority to and the benefit of the filing date of U.S. Provisional Application No. 62/410,993, filed on Oct. 21, 2016, entitled "RIFLE GRIP DEVICE", which is hereby incorporated by reference in its entirety.

FIELD OF THE INVENTION

This patent specification relates to the field of firearm grip assisting devices. More specifically, this patent specification relates to a novel grip device configured to be secured to a firearm such as a rifle.

BACKGROUND

The ability to grip a firearm, such as a rifle, is an integral feature which helps to define the usefulness to the firearm. Typical components of a rifle which are used to allow the user to grip and manipulate the rifle may include rifle stocks, pistol grips, hand guards and fore end grips, butt stocks, furniture sets, and the like. While these components facilitate the manipulation of a rifle, they also may contribute to the perceived use of the rifle. For example, some people may perceive rifles with wood stocks as a hunting weapon, and some people may perceive rifles with pistol grips and black plastic grip components as a dangerous non-useful weapon. By selecting certain grip components for use on a rifle, whether by choice or by law, the way a firearm may be perceived by other people may be changed.

Therefore a need exists for novel grip assisting devices which may be secured to a firearm such as a rifle. There is also a need for novel rifle grip assisting devices which facilitate the ability of a user to securely grip and manipulate a rifle to which the device is attached. A further need exists, for novel rifle grip assisting devices which may change the way the rifle to which they are attached may be perceived. Finally, a need exists for novel rifle grip assisting devices which are able to be easily coupled and uncoupled from a rifle.

BRIEF SUMMARY OF THE INVENTION

A rifle grip device is provided which facilitates a secure and more orthodox grasp of a firearm, such as a rifle, by the user's trigger hand when a pistol grip original to the firearm is not desired and removed, the removal of which compromises the original secure grip of the firearm. In some embodiments, the device may include a body configured to be attached to a pistol grip interface of a firearm with the body having a first end and a second end. A receiver plate may be disposed on the body, and the receiver plate may have a receiver mating surface. A stock plate may be disposed on the body, and the stock plate may have a stock mating surface disposed between the receiver plate and the second end. A first finger ridge may be disposed on the body opposite to the stock plate. A first finger surface may extend along the body and onto the first finger ridge so that both the first finger ridge may form a portion of a first finger surface and the body opposite to the receiver plate may form a portion of a first finger surface, and preferably the first finger surface may be generally horizontally aligned between the first end and second end of the body.

In further embodiments, the device may include a body configured to be attached to a pistol grip interface of a firearm, and the body may have a first end and a second end. A receiver plate may be disposed on the body, and the receiver plate may have a receiver mating surface. A stock plate may be disposed on the body, and the stock plate may have a stock mating surface disposed between the receiver plate and the second end. A first finger ridge may be disposed on the body opposite to the receiver plate. A first finger surface may extend along the body and onto the first finger ridge. A second finger ridge may also be disposed on the body opposite to the stock plate and/or receiver plate. A second finger surface may be disposed on the body between the first finger ridge and the second finger ridge. The first finger surface and second finger surface may be generally horizontally aligned between the first end and second end of the body.

In still further embodiments, the device may include a fastener aperture, may be formed into the body or formed by a fastener that is coupled to the body, may be configured to secure the device to a firearm, such as a rifle, preferably by mating the receiver plate to the receiver of the firearm and/or by mating the stock plate to the stock of the firearm.

BRIEF DESCRIPTION OF THE DRAWINGS

Some embodiments of the present invention are illustrated as an example and are not limited by the figures of the accompanying drawings, in which like references may indicate similar elements and in which.

DETAILED DESCRIPTION OF THE INVENTION

The terminology used herein is for the purpose of describing particular embodiments only and is not intended to be limiting of the invention. As used herein, the term "and/or" includes any and all combinations of one or more of the associated listed items. As used herein, the singular forms "a," "an," and "the" are intended to include the plural forms as well as the singular forms, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof.

Figure 1:
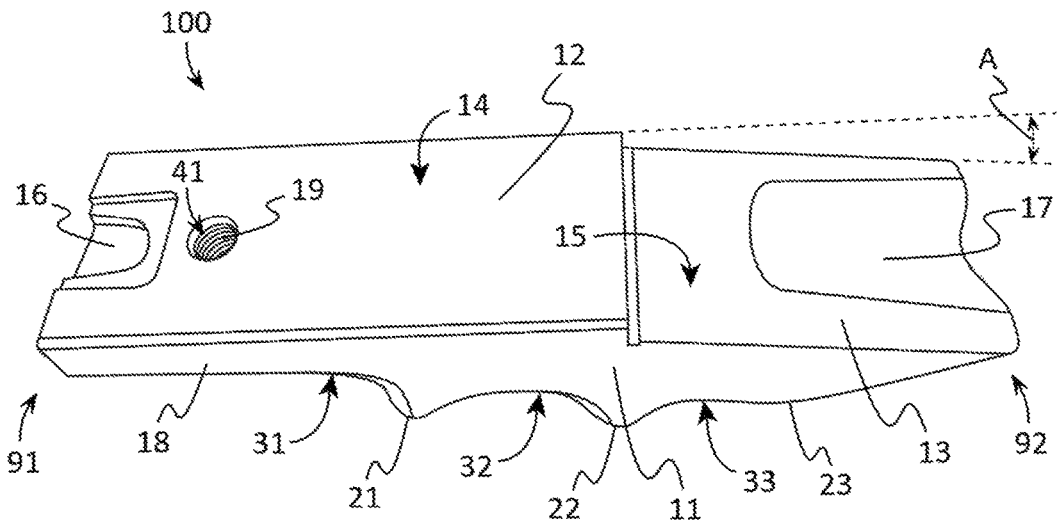
FIG. 1 depicts a top perspective view of an example of a rifle grip device according to various embodiments described herein.

For purposes of description herein, the terms "upper", "lower", "left", "right", "rear", "front", "side", "vertical", "horizontal", and derivatives thereof shall relate to the invention as oriented in FIG. 1. However, one will understand that the invention may assume various alternative orientations and step sequences, except where expressly specified to the contrary. Therefore, the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Although the terms "first", "second", etc. are used herein to describe various elements, these elements should not be limited by these terms. These terms are only used to distinguish one element from another element. For example, the first element may be designated as the second element, and the second element may be likewise designated as the first element without departing from the scope of the invention.

As used in this application, the term "about" or "approximately" refers to a range of values within plus or minus 10% of the specified number. Additionally, as used in this application, the term "substantially" means that the actual value is within about 10% of the actual desired value, particularly within about 5% of the actual desired value and especially within about 1% of the actual desired value of any variable, element or limit set forth herein.

Unless otherwise defined, all terms (including technical and scientific terms) used herein have the same meaning as commonly understood by one having ordinary skill in the art to which this invention belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein.

In describing the invention, it will be understood that a number of techniques and steps are disclosed. Each of these has individual benefit and each can also be used in conjunction with one or more, or in some cases all, of the other disclosed techniques. Accordingly, for the sake of clarity, this description will refrain from repeating every possible combination of the individual steps in an unnecessary fashion. Nevertheless, the specification and claims should be read with the understanding that such combinations are entirely within the scope of the invention and the claims.

A new grip device configure to be secured to a firearm, such as a rifle, is discussed herein. In the following description, for purposes of explanation, numerous specific details are set forth in order to provide a thorough understanding of the present invention. It will be evident, however, to one skilled in the art that the present invention may be practiced without these specific details.

The present disclosure is to be considered as an exemplification of the invention, and is not intended to limit the invention to the specific embodiments illustrated by the figures or description below.

The present invention will now be described by example and through referencing the appended figures representing preferred and alternative embodiments. FIGS. 1-4 illustrate an example of a rifle grip device ("the device") 100 according to various embodiments. In some embodiments, the device 100 may comprise a body 11 configured to be attached to a pistol grip interface 204 of a firearm 200, and the body 11 may have a first end 91 and a second end 92. A receiver plate 12 may be disposed on the body 11, and the receiver plate 12 may have a receiver mating surface 14. A stock plate 13 may be disposed on the body 11, and the stock plate 13 may have a stock mating surface 15 disposed between the receiver plate 12 and the second end 92. A first finger ridge 21 may be disposed on the body 11 opposite to the receiver plate 12. A first finger surface 31 may extend along the body 11 and onto the first finger ridge 21. A second finger ridge 22 may also be disposed on the body 11 opposite to the stock plate 12 and/or receiver plate 12. A second finger surface 32 may be disposed on the body 11 between the first finger ridge 21 and the second finger ridge 22. The first finger surface 31 and second finger surface 32 may be generally horizontally aligned between the first end 91 and second end 92 of the body 11. A fastener aperture 41, may be formed into the body 11 or formed by a fastener 51 that is coupled to the body 11, may be configured to secure the device 100 to a firearm 200 (FIGS. 3 and 4), such as a rifle, preferably by mating the receiver plate 12 to the receiver 201 (FIGS. 3 and 4) of the firearm 200 and/or by mating the stock plate 13 to the stock 202 (FIGS. 3 and 4) of the firearm 200.

In some embodiments, the body 11 may be made of or comprise a generally rigid material such as steel alloys, aluminum, aluminum alloys, copper alloys, any other type of metal or metal alloy, any type of ceramic, various types of hard plastics, such as nylon, acrylic, uPVC, HDPE, melamine, hard rubbers, fiberglass, carbon fiber, resins, such as epoxy resin, wood or any other material including combinations of materials that are substantially rigid with the finger ridges 21, 22, 23, finger surfaces 31, 32, 33, receiver plate 12, and stock plate 13 formed into or coupled to the generally rigid material forming the body 11. In further embodiments, one or more components, such as the finger ridges 21, 22, 23, and/or finger surfaces 31, 32, 33, may be made of or comprise a flexible or resilient material such as silicone foams, silicone rubber, rubber foams, urethane foams, plastic foams, neoprene foam, latex foam rubber, polyurethane foam rubber, or elastomer materials such as elastic plastics, elastic silicone, elastic rubbers, synthetic fabrics such as polyester, acrylic, nylon, rayon, acetate, spandex, lastex, and natural fabrics such as coir, cotton, hemp, jute, canvas, flax, leather, linen, ramie, wool, silk, or any other suitable flexible natural or synthetic material including combinations of materials.

The device 100 may comprise a first finger ridge 21 which may be formed or coupled to the body 11, and the first finger ridge 21 may have or form all or a portion of a first finger surface 31. The first finger ridge 21 and first finger surface 31 may be positioned proximate to the trigger 203 (FIGS. 3 and 4) of the firearm 200 (FIGS. 3 and 4) to which the device 100 is attached. The first finger ridge 21 may extend below the first finger surface 31 (away from the body 11) so that when the device 100 is secured to a firearm 200 and griped by a user, preferably all or a portion of the pad of one or more fingers, may be received by the first finger surface 31 and a portion of a finger received by the first finger surface 31 may be contacted by the first finger ridge 21. In this manner, the first finger ridge 21 and first finger surface 31 may be configured to contact portions of one or more fingers of a user when the device 100 is attached to a firearm 200 and gripped by the hand 300 of the user.

Figure 5:
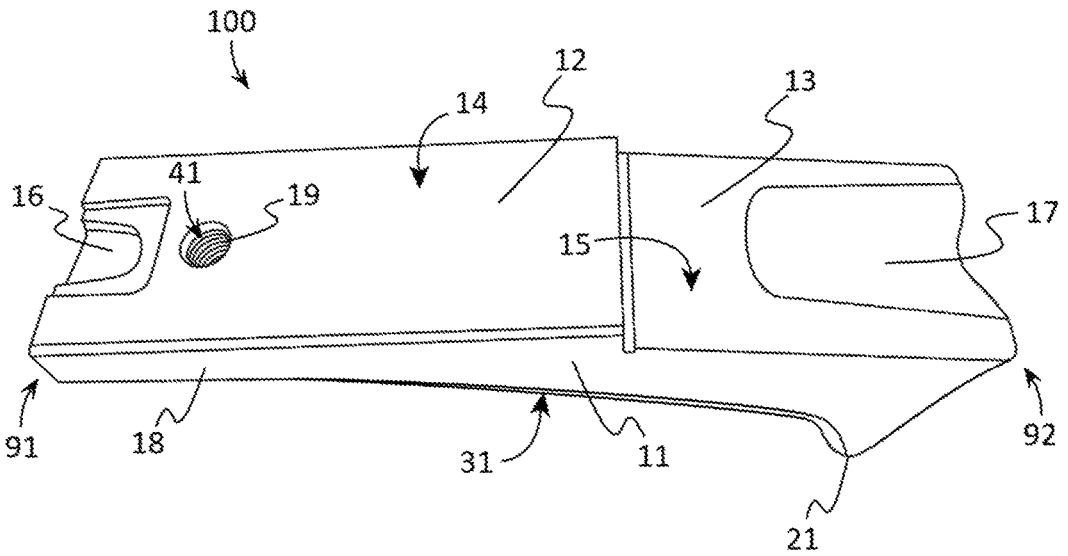
FIG. 5 illustrates a top perspective view of an alternative example of a rifle grip device according to various embodiments described herein.
Figure 6:
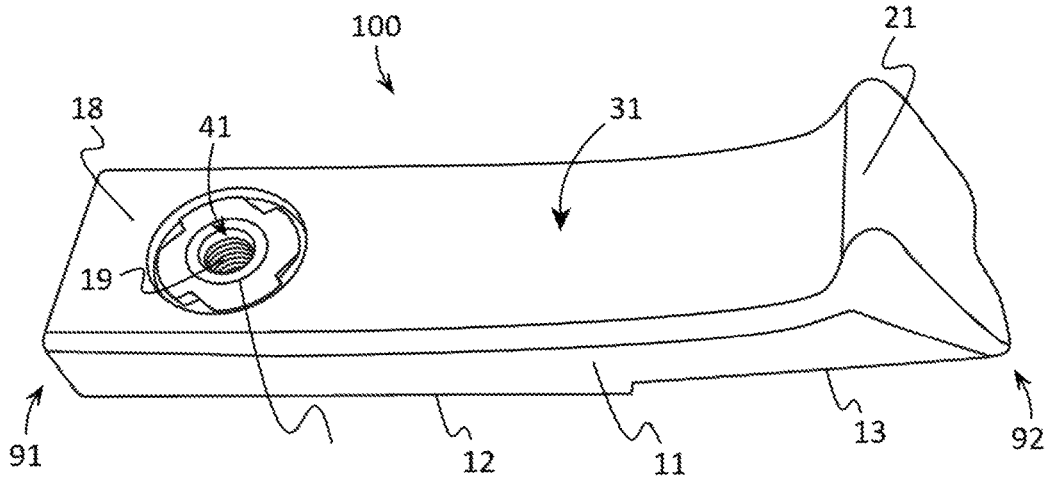
FIG. 6 shows a bottom perspective view of an alternative example of a rifle grip device according to various embodiments described herein.

In some embodiments, the first finger ridge 21 and the first finger surface 31 may be configured to contact portions of the middle finger 301 of the hand 300 of a user. In further embodiments, the first finger ridge 21 may be configured to contact portions of the ring finger 302 of the hand 300 of a user while the first finger surface 31 may be configured to contact portions of the middle finger 301 and the ring finger 302 of the hand 300 of a user. In still further embodiments an as shown by the examples of FIGS. 5 and 6, the first finger ridge 21 may be configured to contact portions of the little finger 303 of the hand 300 of a user while the first finger surface 31 may be elongated and configured to contact portions of the middle finger 301, the ring finger 302, and the little finger 303 of the hand 300 of a user.

The device 100 may comprise a second finger ridge 22 having a second finger surface 32 which may be formed or coupled to the body 11. The second finger ridge 22 and second finger surface 32 may be positioned distally, relative to the first finger ridge 21, to the first end 91 and therefore distally to the trigger 203 of the firearm 200 to which the device 100 is attached. The second finger ridge 22 may extend away from the body 11 or below the first finger surface 31 and/or the second finger surface 32 so that when the device 100 is secured to a firearm 200 and griped by a user, preferably the pad of one or more fingers, may be received by the second finger surface 32 and a portion of a finger may be contacted by the second finger ridge 22. In this manner, the second finger ridge 22 and second finger surface 32 may be configured to contact portions of one or more fingers of a user when the device 100 is attached to a firearm 200 and gripped by the hand 300 of the user.

In some embodiments, the second finger ridge 22 and the second finger surface 32 may be configured to contact portions of the ring finger of the hand 300 (FIGS. 3 and 4) of a user. In further embodiments, the second finger ridge 22 may be configured to contact portions of the little finger 303 of the hand 300 of a user while the second finger surface 32 may be configured to contact portions of the ring finger 302 and little finger 303 of the hand 300 of a user.

In some embodiments, the device 100 may comprise a third finger surface 33 (FIGS. 1 and 2) which may be formed or coupled to the body 11. The third finger surface 33 may be positioned farthest from the trigger 203, relative to the first finger surface 31 and second finger surface 32, of the firearm 200 (FIGS. 3 and 4) to which the device 100 is attached. Preferably, the third finger surface 33 may be disposed on the body 11 between the second finger ridge 22 and the second end 92. Optionally, the third finger surface 33 may be coupled to or positioned proximate to the second finger ridge 22. Preferably the pad of one or more fingers, may be received by the third finger surface 33. In some embodiments, the third finger surface 33 may be configured to receive a portion of the little finger 303, such as the pad, when the device 100 is attached to a firearm 200 and gripped by the hand 300 of the user.

In some embodiments, the device 100 may comprise a third finger ridge 23 (FIGS. 1 and 2) which may be formed or coupled to the body 11. The third finger ridge 23 may be positioned farthest from the trigger 203, relative to the third finger surface 33, of the firearm 200 to which the device 100 is attached. Preferably, the third finger ridge 23 may be disposed on the body 11 between the third finger surface 33 and the second end 92. Optionally, the third finger ridge 23 may be coupled to or positioned proximate to a third finger surface 33. In some embodiments, the third finger ridge 23 may be configured to receive a portion of the little finger 303, such as the side of the little finger 303, when the device 100 is attached to a firearm 200 and gripped by the hand 300 of the user.

Figure 2:
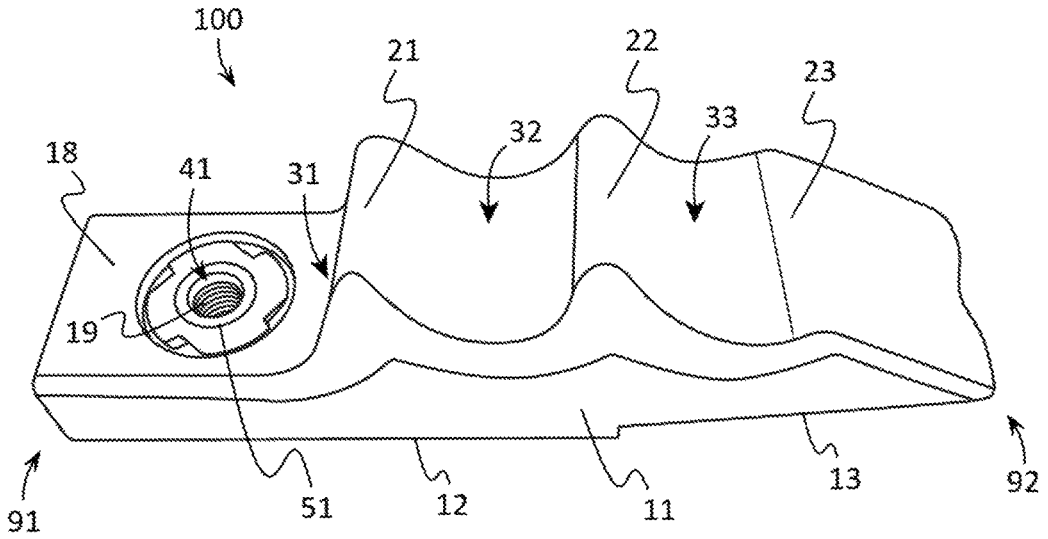
FIG. 2 illustrates a bottom perspective view of an example of a rifle grip device according to various embodiments described herein.
Figure 3:
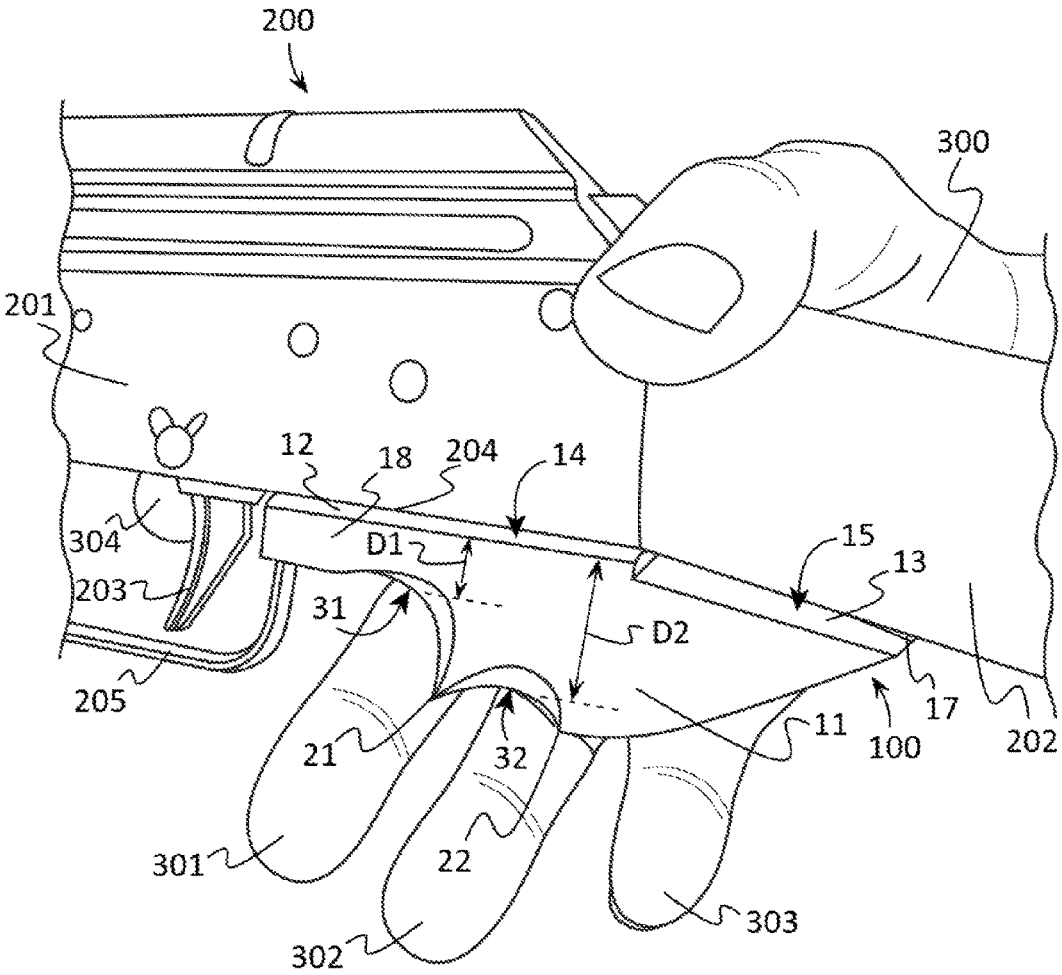
FIG. 3 shows a perspective view of an example of a rifle grip device coupled to the receiver of a rifle type firearm and the hand of a user according to various embodiments described herein.

A finger ridge 21, 22, 23, may be configured with any shape or size which may enable portions of the finger 301, 302, 303, 304, of a user to rest against or be gripped when the user is holding a firearm 200 to which the device 100 is coupled. As perhaps best shown in FIGS. 1-2, a finger ridge 21, 22, 23, may comprise an elongated curved peak shape which may extend away from the body 11. In other embodiments and as shown in FIG. 3, a finger ridge 21, 22, 23, may comprise a generally elongated pointed peak shape which may extend away from the body 11. In other embodiments and as shown in FIGS. 5 and 6, a finger ridge 21, 22, 23, may comprise a generally elongated hook shape which may extend away from the body 11.

A finger surface 31, 32, 33, may be configured with any shape or size which may enable portions of the finger 301, 302, 303, 304, of a user to rest against or be gripped when the user is holding a firearm 200 to which the device 100 is coupled. Optionally, a finger surface 31, 32, 33, may comprise texturing, such as stippling, ridges, or any other grip enhancing surface treatment. As perhaps best shown in FIGS. 1-3, a finger surface 31, 32, 33, may comprise an elongated concave shape which may extend towards the body 11. In other embodiments and as shown in FIGS. 5 and 6, a finger surface 31 may comprise a generally elongated concave shape which may extend a substantial length of the body 11 to the first finger ridge 21.

In some embodiments, a first finger surface 31 may be elongated so as to extend across portions of the body 11 and a first finger ridge 21 as illustrated in FIGS. 5 and 6. An elongated first finger surface 31 may allow a middle finger 301 along with a ring finger 302 and/or little finger 303 to be received on the first finger surface 31. In some embodiments, a first finger ridge 21 may be separated from a second finger ridge 22 so that the second finger surface 32 formed between the two may be elongated in shape. An elongated second finger surface 32 may allow a ring finger 302 and little finger 303 to be received on the second finger surface 32.

In preferred embodiments, the device 100 may comprise a first finger surface 31, second finger surface 32, and third finger surface 33 which may be generally horizontally aligned between the first end 91 and second end of the body 92. In this manner, when gripped by a user, the user's fingers 301, 302, 303, which may each be received in a finger surface 31, 32, 33, may be generally horizontally aligned so as to be generally parallel to portions of the receiver 201 and/or stock 202 of the firearm 201 to which the device 100 is attached as opposed the fingers 301, 302, 303, being generally vertically aligned as they would when engaged to a typical pistol grip. By being generally horizontally aligned between the first end 91 and second end of the body 92, a finger surface 31, 32, 33, may be angled between approximately 0.1 degrees and 20 degrees below or away from the receiver plate 12 and/or stock plate 13.

In some embodiments, the device 100 may comprise a first finger surface 31 which may be disposed or positioned on the body 11 at a first distance (D1) from the receiver plate 12 and a second finger surface 32 which may be disposed or positioned on the body 11 at a second distance (D2) from the receiver plate 12 as shown in FIG. 3. Preferably, D2 may be greater than D1 so that the second finger surface 32 may be disposed on the body 11 a greater distance from the receiver plate 12 than the distance that the first finger surface 31 may be disposed on the body 11 from the receiver plate 12.

A receiver plate 12 may be disposed on the body 11 and opposingly positioned to the finger ridges 21, 22, 23, and the finger surfaces 31, 32, 33. The receiver plate 12 may be positioned proximate to or in contact with portions of the receiver 201, such as a pistol grip interface 204, of the firearm 200 to which the device 100 may be coupled. The receiver plate 12 may comprise one or more receiver mating surfaces 14 which may contact portions of the receiver 201 of the firearm 200 to which the device 100 may be coupled. The receiver mating surfaces 14 may be generally complementary in shape or generally mirrored in shape to portions of the receiver 201 (FIGS. 3 and 4) of a firearm 200 (FIGS. 3 and 4) to which the device 100 is to be attached. In some embodiments, a receiver mating surface 14 may be configured with a generally planar shape that is complementary to portions of the receiver 201 of a firearm 200 having a flat planar shape. In further embodiments, a receiver mating surface 14 may be configured with a generally concave planar shape that is complementary to portions of the receiver 201 of a firearm 200 having a cylindrical or tubular shape.

Optionally, the receiver plate 12 may comprise one or more receiver contour depressions 16 which may be joined, coupled, or positioned with the receiver mating surface 14. A receiver contour depression 16 may be configured to receive and/or contact portions of the receiver 201 (FIGS. 3 and 4) which are not in the same plane as a receiver mating surface 14. Generally, a receiver contour depression 16 may extend above or below a receiver mating surface 14 to receive portions of the receiver 201, such as portions of a trigger guard 205 and/or portions of screws, rivets, or other fasteners which may secure the trigger guard 205 and receiver 201 together, so that the receiver mating surface 14 may contact portions of the receiver 201 thereby allowing the receiver mating surface 14 to mate with any shaped or irregularly shaped receiver 201.

A stock plate 13 may be disposed on the body 11 and opposingly positioned to the finger ridges 21, 22, 23, and the finger surfaces 31, 32, 33. The stock plate 13 may be positioned proximate to or in contact with portions of the stock 202 of the firearm 200 to which the device 100 may be coupled. The stock plate 13 may comprise one or more stock mating surfaces 15 which may be generally complementary in shape to portions of the stock 202 (FIGS. 3 and 4) of a firearm 200 (FIGS. 3 and 4) to which the device 100 is to be attached. Optionally, a stock mating surface 15 may contact with portions of the stock 202 of the firearm 200 to which the device 100 may be coupled. For example, a stock mating surface 15 may be configured with a generally flat planar shape that is complementary to portions of the stock 202 of a firearm 200 having a flat planar shape. In another example, a stock mating surface 15 may be configured with a generally concave planar shape that is complementary to portions of the stock 202 of a firearm 200 having a cylindrical or tubular shape. Optionally, a stock mating surface 15 may contact with portions of the stock 202 of the firearm 200 to which the device 100 may be coupled.

In some embodiments, the stock plate 13 may comprise one or more stock contour depressions 17 which may be joined, coupled, or positioned with the stock mating surface 15. A stock contour depression 17 may be configured to receive and/or contact portions of the stock 202 (FIGS. 3 and 4) which are not in the same plane as a stock mating surface 15. Generally, a stock contour depression 17 may extend above or below a stock mating surface 15 to receive portions of the stock 202 so that the stock mating surface 15 may contact portions of the stock 202 thereby allowing the stock mating surface 15 to mate with any shaped or irregularly shaped stock 202.

In some embodiments, the device 100 may comprise a receiver plate 12 and a stock plate 13, and the stock plate 13 may be angled away from the receiver plate 12 as shown with Angle A in FIG. 1. In further embodiments, the device 100 may comprise a receiver mating surface 14 and a stock mating surface 15, and the stock mating surface 15 may be angled away from the receiver mating surface 14 as shown with Angle A in FIG. 1. In still embodiments, Angle A may be between approximately 0.1 degrees and 45 degrees and more preferably between 5.0 and 25 degrees.

Figure 4:
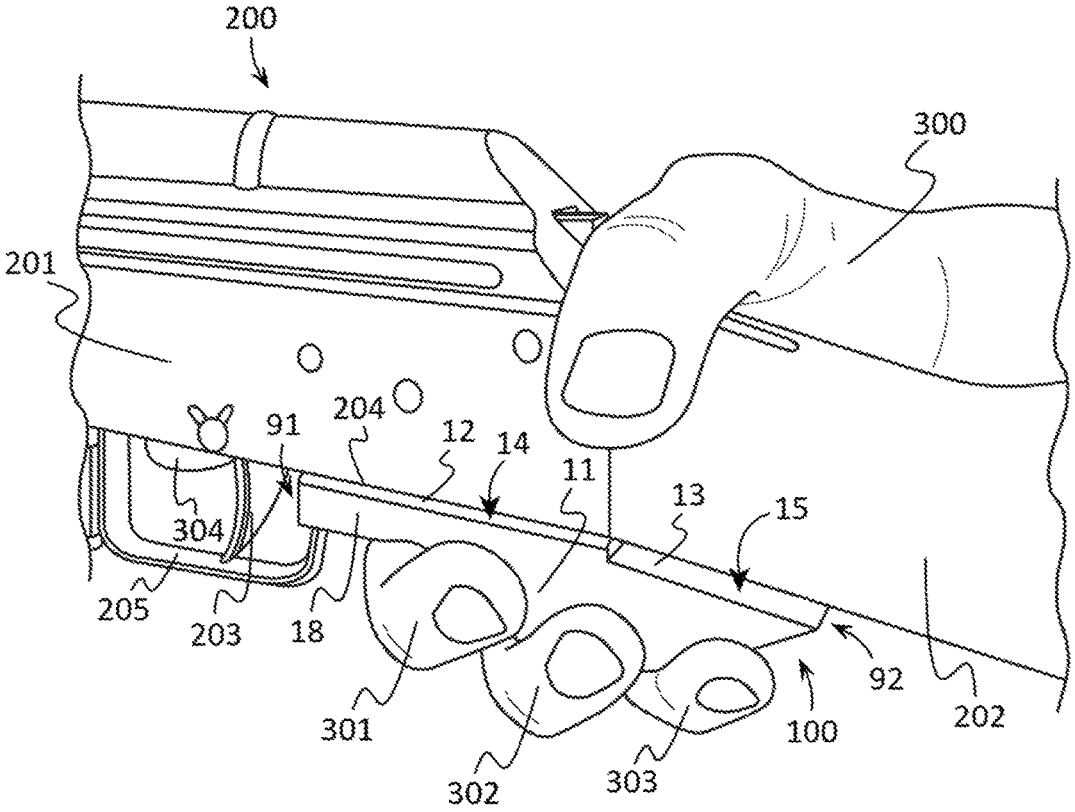
FIG. 4 depicts a perspective view of an example of a rifle grip device coupled to the receiver of a rifle type firearm being griped by the hand of a user according to various embodiments described herein.

The device 100 may comprise one or more fastener apertures 41 which may be configured to receive an attachment fastener that may be used to secure the device 100 a firearm 200 (FIGS. 3 and 4). A fastener aperture 41 may be used to removably couple or removably attach the device 100 to a pistol grip interface 204 of a firearm 200. Pistol grip interfaces 204 are common to firearms 200 having a pistol grip and generally form the portion of the receiver 201 to which a pistol grip may be engaged usually via a threaded fastener. In some embodiments, a fastener aperture 41 may be formed into the body 11, such as into the extension 18. Optionally, the fastener aperture 41 formed by the body 11 may comprise threading 19 which may be configured to engage with the threading of an attachment fastener, such as a screw, bolt, breadboard screw, and the like, that is able to be threadedly attached to the pistol grip interface 204 of a firearm 200 thereby allowing the attachment fastener to threadedly secure the body 11 to the firearm 200. In alternative embodiments, the fastener aperture 41 may not comprise threading 19 but is able to receive a threaded and/or non-threaded attachment fastener, such as a rivet, adhesive, pin, or the like, that is configured to engage with the firearm 200 thereby allowing the attachment fastener to threadedly or non-threadedly secure the body 11 to the firearm 200.

In some embodiments, a fastener aperture 41 may be formed by a fastener 51, such as a rivet nut, washer, or the like, which may be coupled to the body 11, such as to the extension 18. Optionally, the fastener aperture 41 formed by the fastener 51 may comprise threading 19 which may be configured to engage with the threading of an attachment fastener, such as a screw, bolt, and the like, that is able to be threadedly attached to a firearm 200 thereby allowing the attachment fastener to threadedly secure the body 11 to the firearm 200. In alternative embodiments, the fastener aperture 41 of the fastener 51 may not comprise threading 19 but is able to receive a threaded and/or non-threaded attachment fastener, such as a rivet, adhesive, pin, or the like, that is configured to engage with the firearm 200 thereby allowing the attachment fastener to threadedly or non-threadedly secure the body 11 to the firearm 200.

Optionally, the body 11 may comprise an extension 18 into which a fastener aperture 41 may be disposed and which may provide separation between the first finger surface 31 and/or first finger ridge 21 and the trigger 203 of the firearm 200 to which the device 100 may be attached.

Turning now to FIGS. 3 and 4, an example of a rifle grip device 100 attached or coupled to the receiver 201 of a rifle type firearm 200 is depicted. In this example, the device 100 is attached or coupled to the firearm 200 behind the trigger 203 so that preferably the receiver plate 12 is contacting or mating with portions of the receiver 201 and preferably the stock plate 13 is contacting or mating with portions of the stock 202. In this manner, the device 100 facilitates a secure and more orthodox grasp of a rifle type firearm 200 by the user's trigger hand 300, for example, when an original pistol grip native to the firearm 200 is not desired and removed.

In this and some embodiments, once gripped by the hand 300 of the user, the index finger 304 may manipulate the trigger 203 while the middle finger 301 may be positioned in the first finger surface 31 and in contact with the first finger ridge 21. The ring finger 302 may be positioned in the second finger surface 32 and in contact with the second finger ridge 22. The little finger 303 may be positioned in the optional third finger surface 33 (FIGS. 1 and 2) and in contact with the optional third finger ridge 23 (FIGS. 1 and 2).

FIGS. 5 and 6 illustrate an alternative embodiment of a rifle grip device 100 according to various embodiments described herein. In this example, the device 100 may comprise a body 11 configured to be attached to a pistol grip interface 204 of a firearm 200 with the body 11 having a first end 91 and a second end 92. A receiver plate 12 may be disposed on the body 11, and the receiver plate 12 may have a receiver mating surface 14. A stock plate 13 may be disposed on the body 11, and the stock plate 13 may have a stock mating surface 15 disposed between the receiver plate 12 and the second end 92. A first finger ridge 21 may be disposed on the body 11 opposite to the stock plate 13. A first finger surface 31 may extend along the body 11 and onto the first finger ridge 21 so that both the first finger ridge 21 may form a portion of a first finger surface 31 and the body 11 opposite to the receiver plate 12 may form a portion of a first finger surface 31, and the first finger surface 31 may be generally horizontally aligned between the first end 91 and second end 92 of the body 11.

In some embodiments, and as perhaps best shown in FIGS. 5 and 6, two or more fingers 301, 302, 303, 304, may be placed in one or more finger surfaces 31, 32, 33. In the example of FIGS. 5 and 6, a first finger surface 31 may be elongated so as to extend across portions of the body 11 and a first finger ridge 21 so that the first finger surface 31 may be shaped to receive the middle finger 301, ring finger 302, and little finger 303 with portions of the little finger 303 contacting the first finger ridge 21. In alternative embodiments, a first finger surface 31 may be shaped to receive the middle finger 301 and ring finger 302 with portions of the ring finger 302 contacting the first finger ridge 21. In further alternative embodiments, a second finger surface 32 may be shaped to receive the ring finger 302 and little finger 303 with portions of the little finger 303 contacting the second finger ridge 22.

In some embodiments, the device 100 may comprise a first finger surface 31 which may be generally horizontally aligned between the first end 91 and second end of the body 92. In this manner, when gripped by a user, the user's fingers 301, 302, 303, which may each be received in the first finger surface 31, may be generally horizontally aligned so as to be generally parallel to portions of the receiver 201 and/or stock 202 of the firearm 201 to which the device 100 is attached as opposed the fingers 301, 302, 303, being generally vertically aligned as they would when engaged to a typical pistol grip. By being generally horizontally aligned between the first end 91 and second end of the body 92, a first finger surface 31 may be angled between approximately 0.1 degrees and 20 degrees below or away from the receiver plate 12 and/or stock plate 13. In further embodiments, the device 100 may comprise a first finger surface 31 and a second finger surface 32 which may be generally horizontally aligned between the first end 91 and second end of the body 92. In this manner, when gripped by a user, the user's fingers 301, 302, 303, which may each be received in or on the first finger surface 31 and second finger surface 32, may be generally horizontally aligned so as to be generally parallel to portions of the receiver 201 and/or stock 202 of the firearm 201 to which the device 100 is attached as opposed the fingers 301, 302, 303, being generally vertically aligned as they would when engaged to a typical pistol grip. By being generally horizontally aligned between the first end 91 and second end of the body 92, a first finger surface 31 and second finger surface 32 may be angled between approximately 0.1 degrees and 20 degrees below or away from the receiver plate 12 and/or stock plate 13.

While some preferred component shapes has be provided, it should be understood to one of ordinary skill in the art that the body 11 and one or more components, such as a receiver plate 12, optional stock plate 13, optional receiver contour depression 16, optional stock contour depression 17, optional extension 18, first finger ridge 21, optional second finger ridge 22, optional third finger ridge 23, first finger surface 31, optional second finger surface 32, and/or optional third finger surface 33 may be configured in a plurality of sizes and shapes including "T" shaped, "X" shaped, square shaped, rectangular shaped, cylinder shaped, cuboid shaped, hexagonal prism shaped, triangular prism shaped, or any other geometric or non-geometric shape, including combinations of shapes. It is not intended herein to mention all the possible alternatives, equivalent forms or ramifications of the invention. It is understood that the terms and proposed shapes used herein are merely descriptive, rather than limiting, and that various changes, such as to size and shape, may be made without departing from the spirit or scope of the invention.

While some materials have been provided, in other embodiments, the elements that comprise the device 100 such as the body 11, receiver plate 12, optional stock plate 13, receiver mating surface 14, optional stock mating surface 15, optional stock contour depression 17, optional extension 18, first finger ridge 21, optional second finger ridge 22, optional third finger ridge 23, first finger surface 31, optional second finger surface 32, optional third finger surface 33, and/or any other element discussed herein may be made from durable materials such as aluminum, steel, other metals and metal alloys, wood, hard rubbers, hard plastics, fiber reinforced plastics, carbon fiber, fiber glass, resins, polymers or any other suitable materials including combinations of materials. Additionally, one or more elements may be made from or comprise durable and slightly flexible materials such as soft plastics, silicone, soft rubbers, or any other suitable materials including combinations of materials. In some embodiments, one or more of the elements that comprise the device 100 may be coupled or connected together with heat bonding, chemical bonding, adhesives, clasp type fasteners, clip type fasteners, rivet type fasteners, threaded type fasteners, other types of fasteners, or any other suitable joining method. In other embodiments, one or more of the elements that comprise the device 100 may be coupled or removably connected by being press fit or snap fit together, by one or more fasteners such as hook and loop type or Velcro® fasteners, magnetic type fasteners, threaded type fasteners, sealable tongue and groove fasteners, snap fasteners, clip type fasteners, clasp type fasteners, ratchet type fasteners, a push-to-lock type connection method, a turn-to-lock type connection method, slide-to-lock type connection method or any other suitable temporary connection method as one reasonably skilled in the art could envision to serve the same function. In further embodiments, one or more of the elements that comprise the device 100 may be coupled by being one of connected to and integrally formed with another element of the device 100.

Although the present invention has been illustrated and described herein with reference to preferred embodiments and specific examples thereof, it will be readily apparent to those of ordinary skill in the art that other embodiments and examples may perform similar functions and/or achieve like results. All such equivalent embodiments and examples are within the spirit and scope of the present invention, are contemplated thereby, and are intended to be covered by the following claims.

What is claimed is:

1. A rifle grip device, the device comprising:

a. a body configured to be attached to a grip interface of a firearm, the body having a first end and a second end, the first end comprising a receiver contour depression configured to mate with a firearm receiver and the second end comprising a stock contour depression configured to mate with a firearm stock;

b. a rigid receiver plate disposed on the body first end, the rigid receiver plate having a planar shaped receiver mating surface;

c. a stock plate disposed on the body second end, the stock plate having a stock mating surface disposed between the rigid receiver plate and the second end;

d. a first finger ridge disposed on the body;

e. a first finger surface extending along the body and onto the first finger ridge, wherein the first finger surface is generally horizontally aligned between the first end and second end of the body; and f. the stock contour depression recessed within the stock mating surface, the stock contour depression configured to receive portions of the firearm stock.

2. The device of claim 1, wherein the first finger ridge is disposed on the body opposite to the stock plate.

3. The device of claim 1, further comprising a fastener aperture on the rigid receiver plate disposed proximate to the receiver contour depression.

4. The device of claim 3, wherein the fastener aperture comprises threading.

5. The device of claim 1, wherein the stock plate is angled away from the rigid receiver plate.

6. The device of claim 1, wherein a second finger surface is disposed on the body a greater distance from the rigid receiver plate than the distance that the first finger surface is disposed on the body from the rigid receiver plate.

7. The device of claim 1, further comprising a second finger ridge disposed on the body opposite to the rigid receiver plate, and further comprising a second finger surface disposed on the body between the first finger ridge and the second finger ridge, wherein the first finger surface and second finger surface are generally horizontally aligned between the first end and second end of the body.

8. The device of claim 7, further comprising a third finger surface disposed on the body between the second finger ridge and the second end.

9. The device of claim 8, wherein the first finger surface, second finger surface, and third finger surface are generally horizontally aligned between the first end and second end of the body.

* * * * *